US010337358B2

(12) United States Patent
Watanabe

(10) Patent No.: US 10,337,358 B2
(45) Date of Patent: Jul. 2, 2019

(54) VALVE TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventor: Kotaro Watanabe, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/756,275

(22) PCT Filed: Aug. 1, 2016

(86) PCT No.: PCT/JP2016/072468
§ 371 (c)(1),
(2) Date: Feb. 28, 2018

(87) PCT Pub. No.: WO2017/047255
PCT Pub. Date: Mar. 23, 2017

(65) Prior Publication Data

US 2018/0252122 A1 Sep. 6, 2018

(30) Foreign Application Priority Data

Sep. 17, 2015 (JP) ..... 2015-183504

(51) Int. Cl.
*F01L 1/34* (2006.01)
*F01L 1/047* (2006.01)
(Continued)

(52) U.S. Cl.
CPC ..... *F01L 1/047* (2013.01); *F01L 1/04* (2013.01); *F01L 1/3442* (2013.01); *F01L 1/356* (2013.01);
(Continued)

(58) Field of Classification Search
CPC . F01L 1/04; F01L 1/356; F01L 1/3442; F01L 1/047; F01L 2001/34453;
(Continued)

(56) References Cited

U.S. PATENT DOCUMENTS 6,382,157 B1 5/2002 Yamauchi et al.
8,171,904 B2 * 5/2012 Watanabe ..... F01L 1/3442 123/90.15
(Continued)

FOREIGN PATENT DOCUMENTS

EP 0 903 541 A2 3/1999
JP H11-094253 A 4/1999
(Continued)

*Primary Examiner* — Zelalem Eshete
(74) *Attorney, Agent, or Firm* — Foley & Lardner, LLP

(57) ABSTRACT

A valve timing control apparatus for an internal combustion engine includes: a drive rotation member; a housing; a vane rotor; and a front plate, the drive rotation member including a positioning mechanism including a guide portion which is formed on an inner circumference surface of the cylindrical wall, and which has an inclined shape whose an inside diameter is decreased from the one axial end side to the other axial end side, a mounting protrusion portion which is formed on the other end side of the guide portion, and on which an outer circumference surface of the housing is mounted to be positioned.

15 Claims, 9 Drawing Sheets

(51) Int. Cl.
*F01L 1/04* (2006.01)
*F01L 1/356* (2006.01)
*F01L 1/344* (2006.01)

(52) U.S. Cl.
CPC ..... *F01L 2001/0471* (2013.01); *F01L 2001/0476* (2013.01); *F01L 2001/0478* (2013.01); *F01L 2001/34453* (2013.01); *F01L 2103/00* (2013.01)

(58) Field of Classification Search
CPC ..... F01L 2001/0478; F01L 2001/0471; F01L 2001/0476; F01L 2103/00
See application file for complete search history.

(56) References Cited

U.S. PATENT DOCUMENTS

| | | | |
|---|---|---|---|
| 9,145,800 | B2 | 9/2015 | Hentsch et al. |
| 2002/0040697 | A1 | 4/2002 | Sugiura et al. |
| 2006/0042580 | A1 | 3/2006 | Suga et al. |

FOREIGN PATENT DOCUMENTS

| | | | |
|---|---|---|---|
| JP | 2002-180808 | A | 6/2002 |
| JP | 2002-227620 | A | 8/2002 |
| JP | 2006-070726 | A | 3/2006 |
| JP | 2014-163380 | A | 9/2014 |

* cited by examiner

VALVE TIMING CONTROL APPARATUS FOR INTERNAL COMBUSTION ENGINE

TECHNICAL FIELD

This invention relates to a valve timing control apparatus for an internal combustion engine which is arranged to variably control opening/closing timings of the internal combustion engine in accordance with a driving state.

BACKGROUND ART

An apparatus described in a patent document 1 described later is a conventional valve timing control apparatus.

This apparatus includes a pulley which has a cylindrical bottomed shape, which includes a cylindrical wall and a bottom wall, and to which a rotational force is transmitted from a crank shaft through a timing belt; a housing which has an annular shape, which is received within the pulley, and which includes front and rear opening ends closed by a pair of disc plates; and a vane rotor which is received within the housing to be rotated relative to the housing, and which is fixed to an end portion of a cam shaft. Advance angle hydraulic chambers and retard angle hydraulic chambers are separated between a plurality of shoes protruding from the inner circumference surface of the housing from a diameter direction in inward directions, and a plurality of vanes of the vane rotor.

The housing including disc-shaped plates is fixed on the bottom wall of the pulley by bolts. An annular clearance is formed between the outer circumference surface of the housing, and the inner circumference surface of the cylindrical wall of the pulley. The annular clearance has a relatively large width for decreasing an entire weight of the apparatus.

PRIOR ART DOCUMENT

Patent Document

Patent Document 1: Japanese Patent Application Publication No. 2014-163380

SUMMARY OF THE INVENTION

Problems which the Invention is Intended to Solve

However, the valve timing control apparatus described in the patent document 1 includes the relatively large annular clearance between the outer circumference surface of the housing, and the inner circumference surface of the pulley for decreasing the entire weight of the apparatus, as described above. When the housing is received and assembled from an axial one end portion into the pulley, it is difficult to position and hold the housing with high accuracy. Accordingly, the assembly operation of the housing with respect to the drive pulley is complicated, so that the working efficiency of the assembly operation is deteriorated.

It is, therefore, an object of the present invention to provide a valve timing control apparatus for an internal combustion engine which is devised to simply position with high accuracy, and thereby to improve the working efficiency of the assembly operation.

Means for Solving the Problem

In the invention described in claim 1, a valve timing control apparatus for an internal combustion engine, the valve timing control apparatus comprises: a drive rotation member including a cylindrical wall to which a rotational force from a crank shaft is transmitted through teeth portions of an outer circumference, and which includes an opening opened on an one axial end side, and a bottom wall which is integrally provided on the other axial end side of the cylindrical wall, and which includes a through hole formed at a center; a housing which has a cylindrical shape, which is received within the drive rotation member, which includes one end opening closed by the bottom wall, and a plurality of shoes protruding from an inner circumference surface, and which includes a plurality of hydraulic chambers formed by the plurality of shoes; a vane rotor which is received within the housing to be rotated relative to the housing, which includes a rotor portion fixed at one end portion of a cam shaft, and vanes provided from an outer circumference surface of the rotor portion in radial directions, and which separates the hydraulic chambers into a retard angle hydraulic chamber and an advance angle hydraulic chamber, with the shoes; and a front plate which closes the other end opening of the housing, and which is connected to the housing and the drive rotation member from an axial direction, the drive rotation member including a positioning mechanism including a guide portion which is formed on an inner circumference surface of the cylindrical wall, and which has an inclined shape whose an inside diameter is decreased from the one axial end side to the other axial end side, a mounting protrusion portion which is formed on the other end side of the guide portion, and on which an outer circumference surface of the housing is mounted to be positioned.

Benefit of the Invention

By the present invention, the simple positioning operation with the high accuracy is performed when the housing is assembled to the drive rotation member. With this, it is possible to improve the working efficiency of the assembly operation.

DESCRIPTION OF EMBODIMENTS

Hereinafter, valve timing control apparatuses for an internal combustion engine according to embodiments of the present invention are explained with reference to the drawings. Besides, the embodiments show the valve timing control apparatuses which are applied to an exhaust side.

First Embodiment

Figure 1:
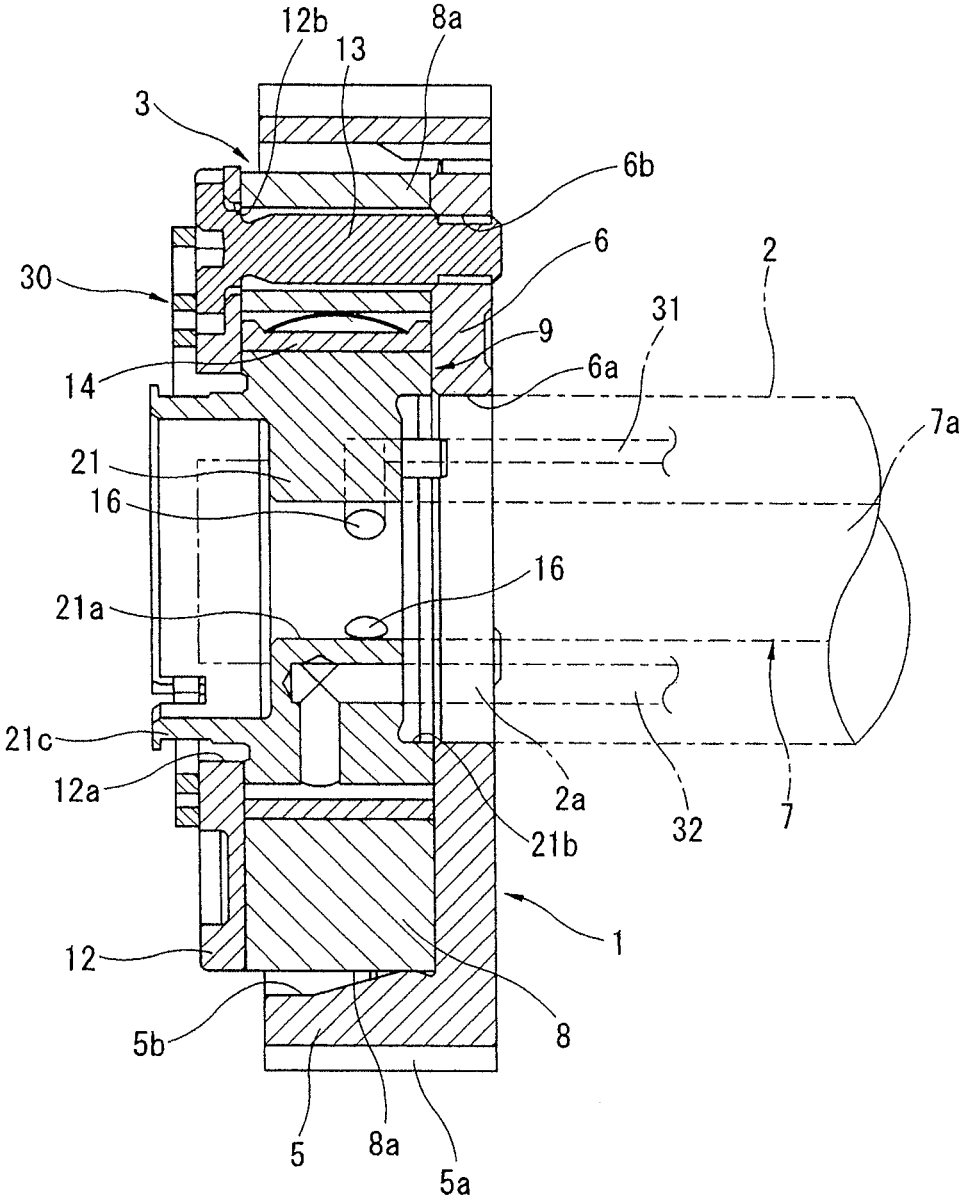
FIG. 1 is a longitudinal section view showing a valve timing control apparatus according to a first embodiment of the present invention.
Figure 2:
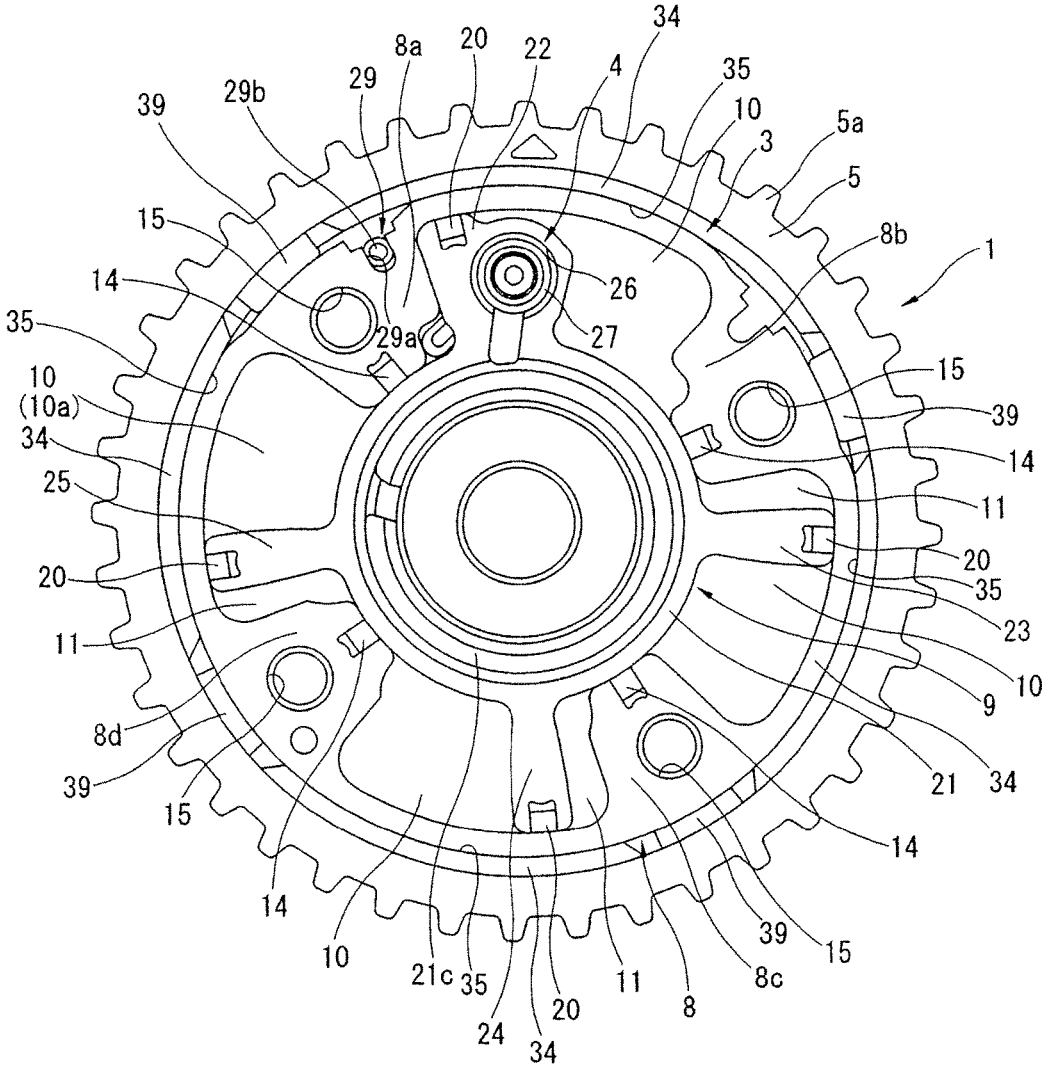
FIG. 2 is a front view showing a state where a front plate of the valve timing control apparatus according to the embodiment is detached.

As shown in FIG. 1 and FIG. 2, the valve timing control apparatus includes a drive pulley 1 which is rotationally driven by a crank shaft (not shown) through a timing belt; a cam shaft 2 which is provided to be rotated with respect to the drive pulley 1; a phase varying mechanism 3 disposed between the drive pulley 1 and the cam shaft 2, and arranged to convert a relative pivot phase of the drive pulley 1 and the cam shaft 2; and a lock mechanism 4 arranged to lock the actuation of the phase varying mechanism 3.

As shown in FIG. 1 to FIG. 4, the drive pulley 1 is integrally made from a sintered alloy. The drive pulley 1 is formed into a bottomed cylindrical shape. The drive pulley 1 includes a cylindrical wall 5 which has a cylindrical shape; and a bottom wall 6 which has a disc shape, and which is formed on an axial one end portion of the cylindrical wall 5. The cylindrical wall 5 is formed to have a predetermined thickness to ensure a rigidity. The cylindrical wall 5 includes a gear 5*a* which is formed on an outer circumference of the cylindrical wall 5, and around which the timing belt is wound.

The cylindrical wall 5 includes an inner circumference surface 5*b* having an inside diameter d larger than an outside diameter d1 of a housing 8 described later. An annular clearance C is formed between the inner circumference surface 5*b* and an outer circumference surface 8*e* of the housing 8 so as to decrease a weight.

The bottom wall 6 is formed to have a thickness necessary for ensuring the rigidity. The bottom wall 6 includes a support hole 6 which is formed at a center of the bottom wall 6, which penetrates through the bottom wall 6, and through which the axial one end portion 2*a* of the cam shaft 2 is rotatably inserted; and four internal screw holes 6*b* which are formed in an outer circumference portion at a substantially regular interval in the circumferential direction, and into which external screws of bolts 13 described later are screwed.

The cam shaft 2 is rotatably supported through cam bearings on a cylinder head (not shown). A plurality of drive cams are integrally provided at predetermined positions on the outer circumference surface of the cam shaft 2. Each of the drive cams is arranged to open an intake valve (not shown) against a spring force of a valve spring. The cam shaft 2 includes an internal screw hole 2*b* formed at one end portion 2*a*, which extends within the cam shaft 2 in the axial direction, and in which an external screw portion formed on an outer circumference surface of a shaft portion 7*a* of a cam bolt 7 described later is screwed.

The phase varying mechanism 3 includes a housing 8 disposed and received in an internal space surrounded by the cylindrical wall 5 and the bottom wall 6 of the drive pulley 1; a vane rotor 9 which is fixed at the one end portion 2*a* of the cam shaft 2 from the axial direction by the cam bolt 7, and which is received within the housing 8 to be rotated relative to the housing 8; four retard angle hydraulic chambers (retard angle operation chambers) 10 and four advance angle hydraulic chambers (advance angle operation chambers) 11 which are formed within the housing 8, which are separated by first to fourth shoes 8*a* to 8*d* integrally formed on the inner circumference surface of the housing 8, and four vanes 22 to 25 (described later) of the vane rotor 9; and a hydraulic circuit arranged to selectively supply and discharge the hydraulic pressure to and from the retard angle hydraulic chambers 10 and the advance angel hydraulic chambers 11.

The housing 8 is a member separately formed from the drive pulley 1. The housing 8 is formed into a cylindrical shape including both axial end having openings. One axial end opening of the housing 8 is closed by the bottom wall 6 of the drive pulley 1. The other axial end opening is closed by the front plate 12. This housing 8 is integrally joined to the bottom wall 6 together with the front plate 12 by being tightened together by four bolts 13 from the axial direction.

The housing 8 includes the shoes 8*a* to 8*d* formed on the inner circumference surface of the housing 8. Each of the shoes 8*a* to 8*d* is formed into a substantially trapezoid shape in a side view. Each of the shoes 8*a* to 8*d* includes a seal groove formed at a tip end portion along the axial direction. Seal members 14 having substantially U shapes are mounted and fixed, respectively, in the seal grooves. Each of the shoes 8*a* to 8*d* includes a bolt insertion hole 15 which is formed on a radially outer circumference side, that is, on a base portion side that is a connection portion of the each of the shoes 8*a* to 8*d* and the inner circumference surface of the housing 8, which penetrates through the each of the shoes 8*a* to 8*d* in the axial direction, through which the bolt 13 is inserted.

The front plate 12 is formed into a circular plate shape having a relatively small thickness, by press-forming a metal sheet. The front plate 12 includes a large diameter hole 12*a* which is formed at a center of the front plate 12, four bolt holes 12*b* which are formed in the outer circumference portion of the front plate 12 at a regular interval in the circumferential direction, which penetrate the front plate 12, and each of which the bolt 13 is inserted through.

The vane rotor 9 is integrally formed by the metal. As shown in FIG. 1 and FIG. 2, the vane rotor 9 includes a rotor portion 21 which has a cylindrical shape, and which is located at a center of the vane rotor 9; and first to fourth vanes 22 to 25 which are formed on an outer circumference surface of the rotor portion 21 at a substantially regular interval in the circumferential direction, and each of which protrudes in the radial direction.

The rotor portion 21 includes an insertion hole 21*a* formed at a center of the rotor portion 21. The rotor portion 21 is fixed to the one end portion 2*a* of the cam shaft 2 from the axial direction by the cam bolt 7 inserted into the insertion hole 21*a* in the axial direction. The rotor portion 21 is arranged to be rotated so that the outer circumference surface of the rotor portion 21 is slidably moved on the seal members mounted and fixed on the upper surfaces of the tip end portions of the shoes 8*a* to 8*d*. As shown in FIG. 1, this rotor portion 21 includes four retard angle side oil holes 16 which are positioned, respectively, at positions between the vanes 22 to 25, each of which penetrates through the rotor portion 21 in the radial direction, and which are connected to the retard angle hydraulic chambers 10. The rotor portion 21 includes a mounting groove 21*b* which has a circular shape, which is formed on an axial one end surface at a center of the rotor portion 21, and in which the tip end of the one end portion 2*a* of the cam shaft 2 is mounted. Moreover, the rotor portion 21 includes a cylindrical portion 21*c* which is integrally formed on the axial other end portion of the rotor portion 21, and which is inserted into the large diameter portion 12*a* of the front plate 12 with a predetermined clearance.

The vanes 22 to 25 are disposed, respectively, between the shoes 8*a* to 8*d*. Each of the vanes 22 to 25 includes a seal groove which is formed in the axial direction on a tip end surface of the each of the vanes 22 to 25, and in which a seal member 20 is mounted and fixed. Each of the seal members 20 has a substantially U-shape. Each of the seal members 20 is slidably abutted on the inner circumference surface of the housing 8.

As shown in FIG. 2, the first vane 22 has a largest width in the vanes 22 to 25. The other second to fourth vanes 23 to 25 are set to have a substantially identical width which is sufficiently smaller than the width of the first vane 22. In this way, the other second to fourth vanes 25 have the width smaller than the largest width of the first vane 22. With this, an overall weight balance of the vane rotor 9 is uniformized.

When the vane rotor 9 is maximally rotated in a counterclockwise direction in FIG. 2, one side surface of the first vane 22 is abutted on a confronting side surface of the first shoe 8*a*, so that a relative rotation position of the first vane 22 on the maximum retard angle side with respect to the housing 8 is restricted. When the vane rotor 9 is maximally rotated in a clockwise direction, the other side surface of the first vane 22 is abutted on a confronting side of the second shoe 8*b*, so that a relative rotation position of the first vane 22 on the maximum advance side is restricted. Besides, the other vanes 23 to 25 are not abutted on any shoes 8*a* to 8*d* which confront the other vanes 23 to 25 when the first vane 22 is abutted on the first and second shoes 8*a* and 8*b*.

As shown in FIG. 2, the lock mechanism 4 includes a sliding movement hole 26 which is formed inside the first vane 22 (specific vane), and which penetrates through the first vane 22 in the axial direction; a lock pin 27 that is a lock member which is slidably received within the sliding movement hole 26, and which is moved to be projectable and retractable with respect to the bottom wall 6 side; a lock hole 28 that is a lock recessed portion which is formed on a bottom surface of the bottom wall 6, and in which the tip end portion of the lock pin 27 is arranged to be engaged to lock the vane rotor 9; and an engagement/disengagement mechanism arranged to engage and disengage the tip end portion of the lock pin 27 with and from the lock hole 28 in accordance with the state of the engine.

The sliding movement hole 26 includes an inner circumference surface having a substantially uniform inside diameter. The sliding movement hole 26 includes an rear end edge having an air vent groove (not shown) arranged to ensure the good slidability of the lock pin 27. The lock pin 27 includes a tip end portion arranged to be engaged and disengaged with and from the lock hole 28; and a large diameter portion which has a hollow shape, and which is located on a rear side of the tip end portion side. The tip end portion of the lock pin 27 has a solid shape. The tip end portion of the lock pin 27 has an conical outer circumference surface arranged to ease the engagement with the lock hole 28.

The lock hole 28 is formed at a predetermined position of the bottom wall 6. The tip end portion of the lock pin 27 is engaged with the lock hole 28 when the vane rotor 9 is relatively rotated on the maximum retard angle side as shown in FIG. 2. Accordingly, the relative rotation angle between the housing 8 and the vane rotor 9 is set to be a conversion angle which is the maximum retard angle appropriate for the engine start, when the lock pin 27 is engaged with the lock hole 28.

The engagement/disengagement mechanism includes a coil spring (not shown) elastically mounted between an inner wall surface of the tip end portion of the lock pin 27, and the inner end surface of the front plate 12, and arranged to urge the lock pin 27 in the projecting direction (the direction toward the lock hole 28); and an oil groove 6*d* which is formed in the bottom surface of the bottom wall 6, and which is arranged to supply the hydraulic pressure for the lock release from one of the retard angle hydraulic chambers 10 to the lock hole 28, and thereby to disengage (release) the lock pin 27 from the lock hole 28 against the spring force of the coil spring.

A positioning mechanism 29 is provided between the housing 8 and the bottom wall 6. The positioning mechanism 29 is arranged to position rotation positions of the housing 8 and the bottom wall 6, that is, circumferential positions of the tip end portion of the lock pin 27 and the lock hole 28 when the constituting members are assembled by the bolts 13. As shown in FIG. 2, this positioning mechanism 29 includes a positioning groove 29*a* formed in the shoe 8*a* of the housing 8; and a positioning pin 29*b* provided on an inner end surface of the bottom wall 6 on the outer circumference portion side at a position to confront the positioning groove.

Moreover, a torsion spring 30 is provided on an outer end side of the front plate 12. The torsion spring 30 is arranged to constantly provide a rotational force on the advance angle side to the vane rotor 9. This torsion spring 30 includes one end portion retained and fixed to the rotor portion 21 of the vane rotor 9; and the other end portion retained and fixed to the front plate 12.

The hydraulic circuit is briefly explained with reference to FIG. 1. The hydraulic circuit is arranged to selectively supply the hydraulic pressure to the retard angle hydraulic chambers 10 and the advance angle hydraulic chambers 11, and to discharge the oil within the advance angle hydraulic chambers 10 and the retard angle hydraulic chambers 11. The hydraulic circuit includes a retard angle side passage 31 connected to the retard angle side oil holes 16; an advance angle side passage 32 connected to the advance angle side oil grooves (not shown); an electromagnetic switching valve (not shown) provided between the passages 31 and 32; an oil pump (not shown) arranged to selectively supply the hydraulic pressure through the electromagnetic switching valve to the passages 31 and 32; and a drain passage arranged to selectively connected through the electromagnetic switching valve to the retard angle side passage 31 and the advance angle side passage 32. Besides, the suction passage of the oil pump and the drain passage are connected to the oil pan.

Each of the retard angle side and advance angle side passages 31 and 32 includes one end portion formed within the cam shaft one end portion 2*a* in the radial direction and in the axial direction, and connected to an oil passage within the bearing, and a groove formed on the outer circumference of the cam shaft one end portion 2*a*; and the other end portion connected to the passage side oil groove and the retard angle side oil hole 16.

The electromagnetic valve is a two-way valve. The electromagnetic valve is arranged to selectively switch the passages, the discharge passage of the oil pump, and the drain passage, by an output signal from the controller.

The controller includes a computer configured to receive information signals from various sensors such as a crank angle sensor (not shown), an air flow mater (not shown), a water temperature sensor (not shown), and a throttle valve opening degree sensor, to sense a current engine driving state, and to output a control current to an electromagnetic coil of the electromagnetic switching valve in accordance with the engine driving state.

As shown in FIG. 2 to FIG. 5, a positioning mechanism 33 is provided on the inner circumference surface 5*b* of the cylindrical wall 5 of the drive pulley 1. The positioning mechanism 33 is arranged to insert and guide the housing 8 along the cylindrical wall 5 at the assembly operation of the housing 8 into the drive pulley 1, and to position the housing 8 in the maximum insertion state.

Figure 3:
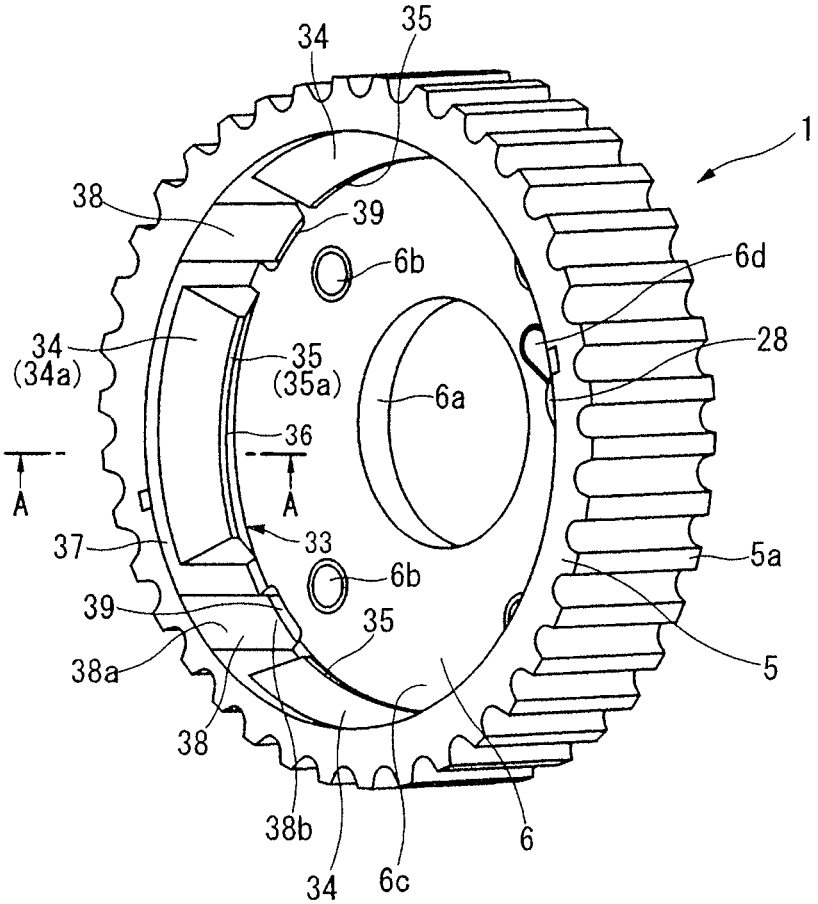
FIG. 3 is a perspective view showing a drive pulley in the embodiment.
Figure 4:
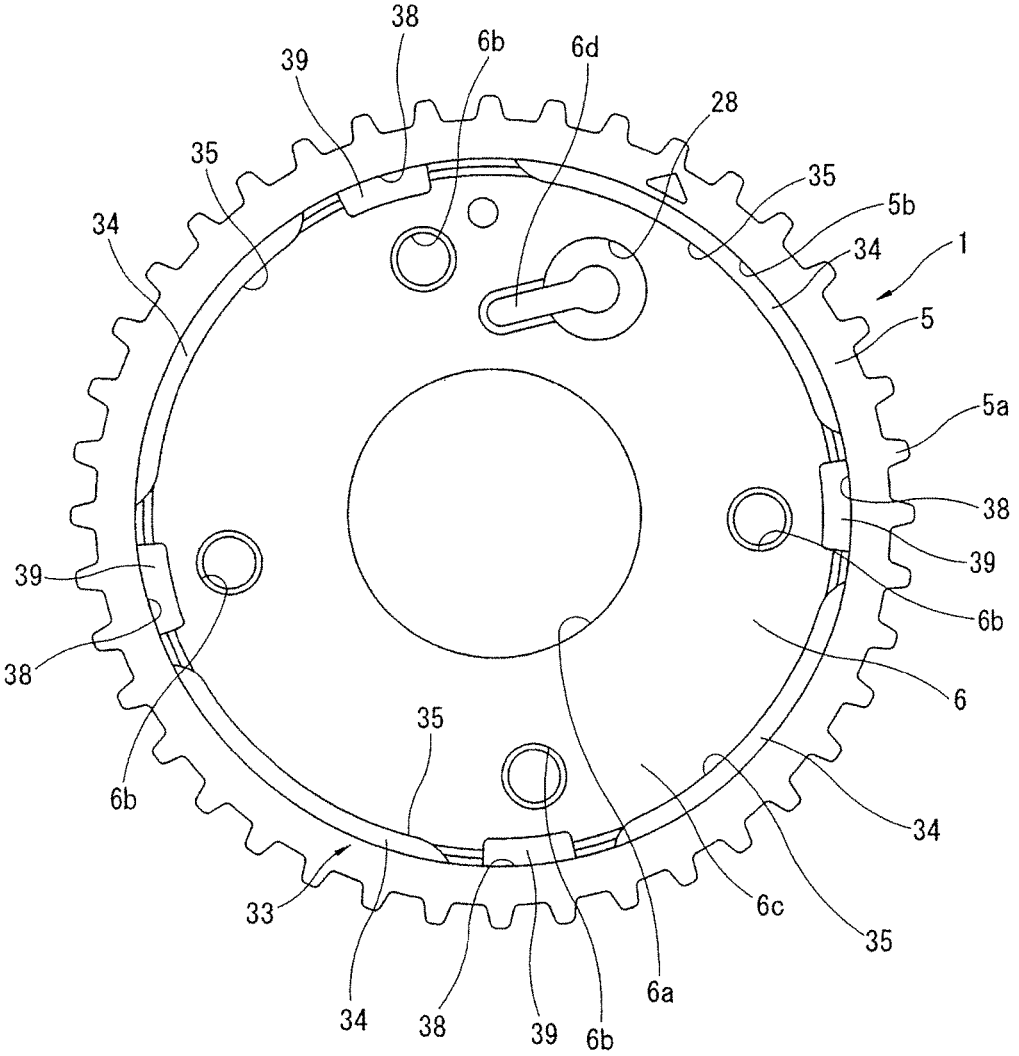
FIG. 4 is a front view showing the drive pulley.
Figure 5:
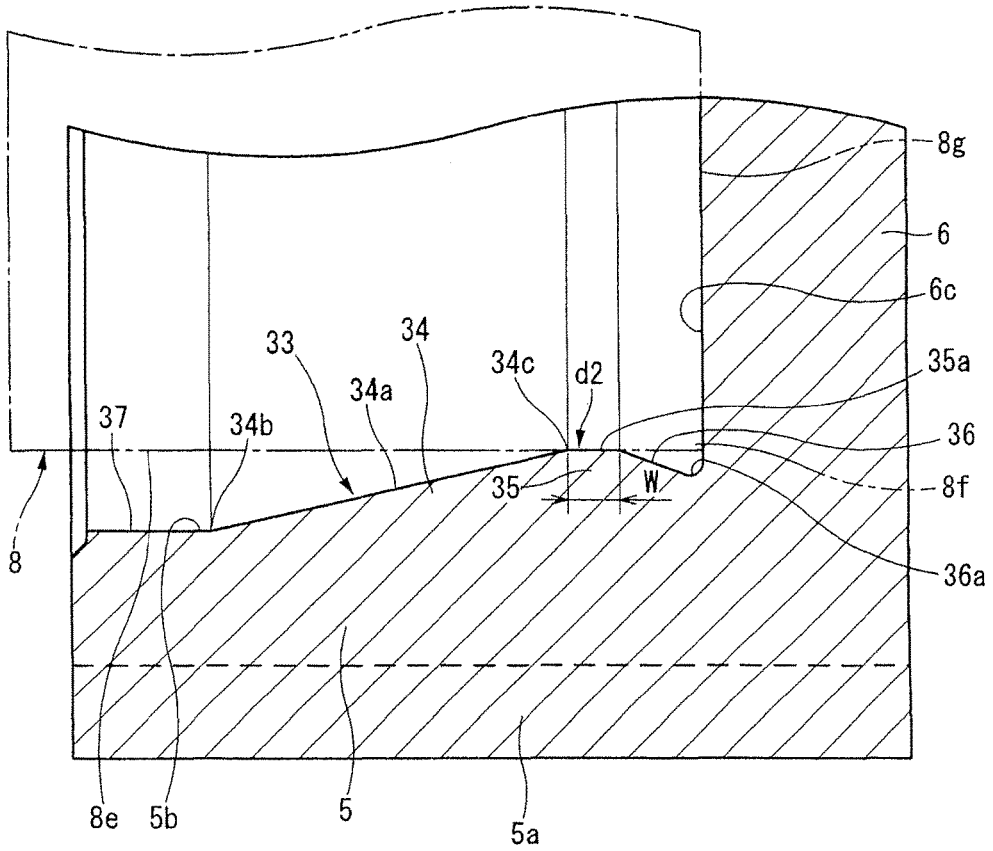
FIG. 5 is a sectional view taken along an A-A line of FIG. 3.

As shown in FIG. 3 to FIG. 5, the positioning mechanism 33 includes guide portions 34 which are guide portions having inclination shapes, and each of which is provided from an substantially axial center position of the inner circumference surface 5*b* of the cylindrical wall 5 toward the bottom wall 6; and mounting protrusion portions 35 each of which is provided on the bottom wall 6 side of the guide portion 34 of the cylindrical wall 5.

Each of the guide portions 34 includes a guide surface 34*a* which is an inner circumference surface, and which is formed into an inclined cylindrical surface shape along the circumferential direction of the inner circumference surface 5*b* of the cylindrical wall 5. The guide portion 34 has an inside diameter which is gradually decreased from the axial one end side 34*b* side toward the other end portion 34*c* of the bottom wall 6 side. That is, the entire inside diameter of the guide surface 34*a* is greater than the outside diameter d1 of the housing 8. The guide surface 34*a* is formed into an upward inclination shape gradually inclined upward from the one end portion 34*b* side to the other end portion 34*c* side.

Each of the mounting protrusion portions 35 is formed to be continuous with the other end portion 34*c* of one of the guide portions 34. Each of the mounting protrusion portions 35 includes a mounting surface 35*a* which is an annular inner circumference surface, which has a predetermined width W, and which has a flat section. Moreover, the mounting surface 35*a* of each of the mounting protrusion portions 35 has an inside diameter d2 which is substantially identical to the outside diameter d1 of the outer circumference surface 8*e* of the housing 8 (a clearance fit). With this, the outer circumference surface 8*e* of the housing 8 is abutted and supported by the mounting surfaces 35*a* of the mounting protrusion portions 35 when the housing 8 is inserted within the guide portions 34 from the axial direction, and the housing 8 reaches the mounting protrusion portions 35.

Moreover, an annular recessed portion 36*a* is formed between each of the mounting protrusion portions 35, and the bottom surface 6*c* of the bottom wall 6, as shown in FIG. 5. Each of the annular recessed portions 36 is recessed on the radially outward side relative to the mounting protrusion portions 35.

Each of the annular recessed portions 36 has a downward inclination shape inclined downward from the inner end edge of the mounting protrusion portion 35 toward the bottom surface 6*c* of the bottom wall 6. Each of the annular recessed portions 36 includes a curved surface portion 36*a* which is a portion connected to the bottom surface 6*c*, and which has a round shape. These curved portions 36*a* serve as escapes for the outer circumference edge 8*f* of the housing 8 when the housing 8 is maximally mounted within the cylindrical wall 5.

In this way, a clearance (side clearance) between the bottom surface 6*c* of the bottom wall 6 and the front end surface 8*g* of the housing 8 received within the cylindrical wall 5 is minimized by the existence of the annular recessed portions 36.

That is, in a case where an R portion (curved surface) is formed at the connection corner portion between the mounting protrusion portion 35 and the bottom surface 6*c* of the bottom wall 6 when the drive pulley 1 is sintered and molded, the outer circumference edge 8*f* of the housing 8 is abutted on the round portion by a linear contact when the housing 8 is maximally mounted within the cylindrical wall 5. With this, a relatively large clearance is formed between the front end surface 8*g* of the housing 8 and the bottom surface 6*c* of the bottom wall 6. Consequently, the hydraulic fluid supplied to the retard angle hydraulic chambers 10 and the advance angle hydraulic chambers 11 is easy to be leaked from the clearance to the outside, so that the control accuracy and the control response of the appropriate relative rotation phase of the vane rotor 9 may be deteriorated. Accordingly, in this embodiment, the annular recessed portions 36 are formed so that the side clearance is decreased. With this, it is possible to suppress the leakage of the hydraulic fluid.

Moreover, it is possible to increase the contact area of the front end surface 8*g* of the housing 8 and the bottom surface 6*c* of the bottom wall 6 by forming the annular recessed portions 36, relative to a case where there is no annular recessed portions like the third embodiment shown in FIG. 9, and described later. Accordingly, it is possible to further suppress the leakage of the hydraulic fluid. Moreover, the necessity of forming the chamfering to avoid the round portions (the curved surfaces) as described above is decreased. Consequently, it is possible to form the outer circumference edge 8*f* of the housing 8 to the acuter angle. With this, it is possible to further increase the contact area between the front end surface 8*g* of the housing and the bottom surface 6*c*.

Furthermore, an annular tapered surface 37 is formed so that a diameter of the annular tapered surface 37 is gradually increased from the one end portion 34*b* of the guide portion 34 of the cylindrical wall 5 to the rear end edge. This tapered surface 37 is formed to have an inclination angle smaller than that of the guide portion 34. The tapered surface 37 is arranged to ensure the die extraction characteristics (mold release characteristics) at the sintered molding of the driving pulley 1.

Besides, each of the annular recessed portions 36 is formed by the mechanical processing by lathe after the drive pulley 1 is integrally formed by the sintering. This mechanical processing is performed together with the mechanical processing of the bottom surface 6*c*. With this, it is possible to decrease the man-hour, and thereby to decrease the cost.

Four groove portions 38 are formed on the inner circumference surface 5*b* of the cylindrical wall 5 at intervals of 90 degrees in the circumferential direction. Each of the groove portions 38 extends along the axial direction. That is, each of the four groove portions 38 is formed to extend in the axial direction to have a predetermined width. The four groove portions 38 are formed to separate the positioning mechanisms 33 into four section, from the axial direction. Each of the groove portions 38 includes one end edge which is positioned on one end side in the longitudinal direction, and which is continuous with the tapered surface 37; and the other end edge 38*b* which is positioned on the other end side in the longitudinal direction, and which extends to the bottom surface 6*c* of the bottom wall 6.

Moreover, the bottom wall 6 includes oil drain holes 39 each of which is formed on the bottom surface 6*c* at a position corresponding to the other end edge 38*b* of the groove portion 38, and each of which penetrates through the bottom wall 6. Each of the oil drain holes 39 has a depth set so that the oil drain hole 39 is positioned outside the outer circumference surface 8*e* of the housing 8 in a state where the housing 8 is mounted in the cylindrical wall 5. Each of the oil drain holes 39 has a width identical to that of the other end edge 38*b*. Each of the oil drain holes 39 is continuous with one of the other end edges 38*b*. Each of the oil drain holes 39 has an outer end side connected to the outside.

In particular, one of the mounting protrusion portions 35 is mounted on the outer circumference surface 8*e* of the housing 8 of the retard angle hydraulic chamber 10*a* (specific operation chamber) which is located on a side of the shoe 8*a* on which the vane 22 (the specific vane) is not abutted. The vane 22 is provided with the lock pin 27. The vane 22 has a weight greater than those of the other vanes 23 to 25. Accordingly, when the vane 22 is contacted on the shoe 8*a* by the alternating torque acted to the cam shaft 2, the rotational moment is acted to the shoe 8*a*. With this, the outer circumference surface 8*e* of the housing 8 of the retarded hydraulic chamber 10*a* (the specified operation chamber) having the relatively small thickness may be deformed in the radially outward direction. However, one of the mounting protrusion portions 35 is mounted on the outer circumference surface 8*e* of the housing 8. Consequently, it is possible to suppress the deformation of the outer circumference surface of the housing 8.

Hereinafter, the process of the assembling operation of the housing 8 and so on with respect to the drive pulley 1 in this embodiment is explained. Besides, explanations of the tightening operation between the one end portion 2*a* of the cam shaft 2 and the vane rotor 9 by the cam bolt 7 is omitted.

Firstly, the vane rotor 9 is previously positioned and assembled to the housing 8 though the seal members 14 and 20. Next, this housing unit is assembled within the pulley 1. The drive pulley 1 is previously fixed as a base so that the bottom wall 6 directs downwards. In this state, the housing unit is assembled from the upward direction.

At this time, the housing 8 is mounted so that the outer circumference edge 8*f* is aligned to (corresponds to) the tapered surface 37 of the cylindrical wall 5 of the drive pulley 1. When the housing 8 is further pushed into, the housing 8 is mounted in the direction of the bottom surface 6*c* while the outer circumference edge 8*f* is guided by the upper surfaces of the guide portions 34. During this mounting (the movement), the housing 8 is moved to be positioned and centered with respect to the axis of the drive pulley 1 by the upper surfaces of the guide portions 34. Then, the outer circumference edge 8*f* of the housing 8 is ridden over the mounting surfaces 35*a* of the mounting protrusion portions 35. With this, the housing 8 is further positioned and moved. As shown in FIG. 5, the entire of the outer circumference surface 8*e* of the housing 8 is finally abutted on the mounting surfaces 35*a*. Moreover, the positioning and centering operation of the housing 8 with respect to the drive pulley 1 in the radial directions is finished in the maximum mounting state in which the front end surface 8*g* is abutted on the bottom surface 6*c* of the bottom wall 6.

Then, the lock pin 27 is received into the sliding movement hole 26 of the lock mechanism 4 from the tip end portion side so that the tip end portion is inserted and engaged in the lock hole. Moreover, after the coil spring is mounted, the front plate 12 is positioned, abutted, and disposed on the rear end surface of the housing 8. In this state, the housing 8 and the front plate 12 are fixed to the bottom wall 6 of the drive pulley 1 from the axial direction by being tightened by the bolts 13. Moreover, the torsion spring 30 is mounted on the outer side surface side of the front plate 12. The assembling operation of the constituting components is finished.

As descried above, in this embodiment, the positioning operation at the assembly operation of the housing 8 with respect to the drive pulley 1 is automatically performed by the guide portions 34 and the mounting protrusion portions 35 of the positioning mechanism 33 when the housing 8 is mounted in the cylindrical wall 5. Accordingly, it is possible to extremely simplify and ease the positioning and centering operation, and to perform the positioning operation with high accuracy. Consequently, it is possible to improve the working efficiency of the assembly operation of the housing unit with respect to the drive pulley 1.

Moreover, it is possible to position the housing unit with respect to the drive pulley 1 by the high accuracy by the positioning mechanism 33. The positioning of the lock pin 27 and the lock hole is also improved. Consequently, it is possible to obtain a desired backlash between the tip end portion of the lock pin 27 and the lock hole.

Furthermore, in the assembly operation of the drive pulley 1 and the housing 8, it is unnecessary to chuck fix the outer circumference surface of the housing 8 at three points by generally-performed scroll chuck. Therefore, it is possible to previously avoid the deformation of the housing 8 and so on.

Moreover, it is possible to effectively discharge the hydraulic fluid slightly leaked from the retard angle hydraulic chambers 10 and the advance angle hydraulic chambers 11 from the side crank shaft between the bottom surface 6*c* of the bottom wall 6 and the front end surface 8*g* of the housing 8 during the drive of the valve timing control apparatus, from the groove portions 38 through the oil drain holes 39 to the outside.

Second Embodiment

Figure 6:
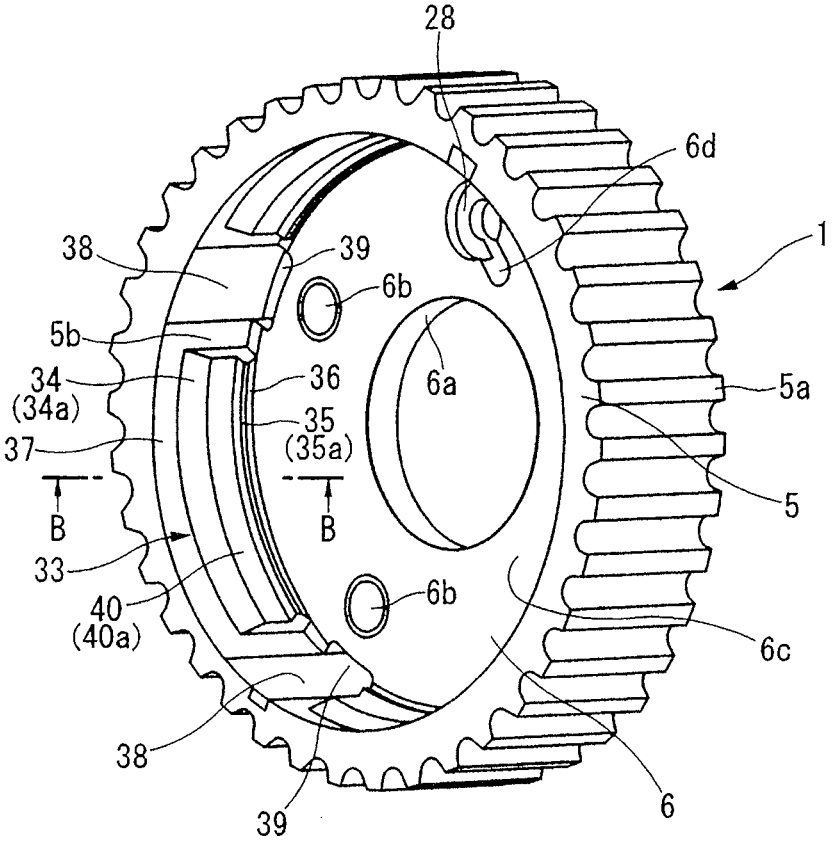
FIG. 6 is a perspective view showing a drive pulley in a second embodiment of the present invention.
Figure 7:
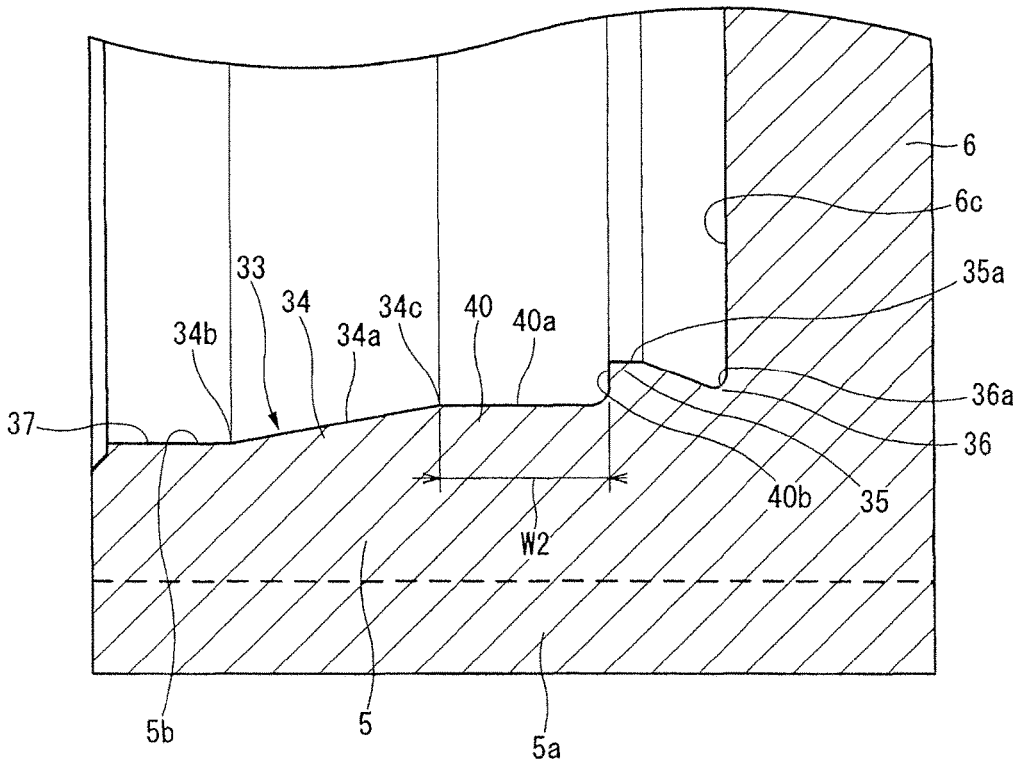
FIG. 7 is a sectional view taken along a B-B line of FIG. 6.

FIG. 6 and FIG. 7 show a second embodiment of the present invention. The second embodiment has a basic configuration identical to that of the first embodiment. However, an approach portion 40 is formed between the guide portion 34 and the mounting protrusion portion 35 of the positioning mechanism 33.

That is, each of the guide portions 34 has an axial length which is a length from the one end portion 34*b* to the other end portion 34*c*, and which is substantially half of the length in the first embodiment. Each of the approach portions 40 is formed between and the other end portion 34*c* and the mounting protrusion portion 35.

This approach portion 40 has a stepped shape. The approach portion 40 is formed by cutting into a substantially annular shape. The approach portion 40 includes an inner circumference surface 40*a* formed into an arc shape. The approach portion 40 has an axial width W2 which is substantially identical to half of the axial length of the guide portion 34 in the first embodiment. The inner circumference surface 40*a* has an inclination which is more obtuse than the inclination of the guide surface 34*a* of the guide portion 34. Preferably, the inner circumference surface 40*a* is formed to be substantially perpendicular to the rotation axis.

Moreover, a stepped surface 40*b* is formed between each of the mounting protrusion portions 35 and one of the approach portions 40 by forming the one of the approach portions 40.

The other annular recessed portions 36 and the tapered surface 37 are identical to those of the first embodiment.

Figure 8:
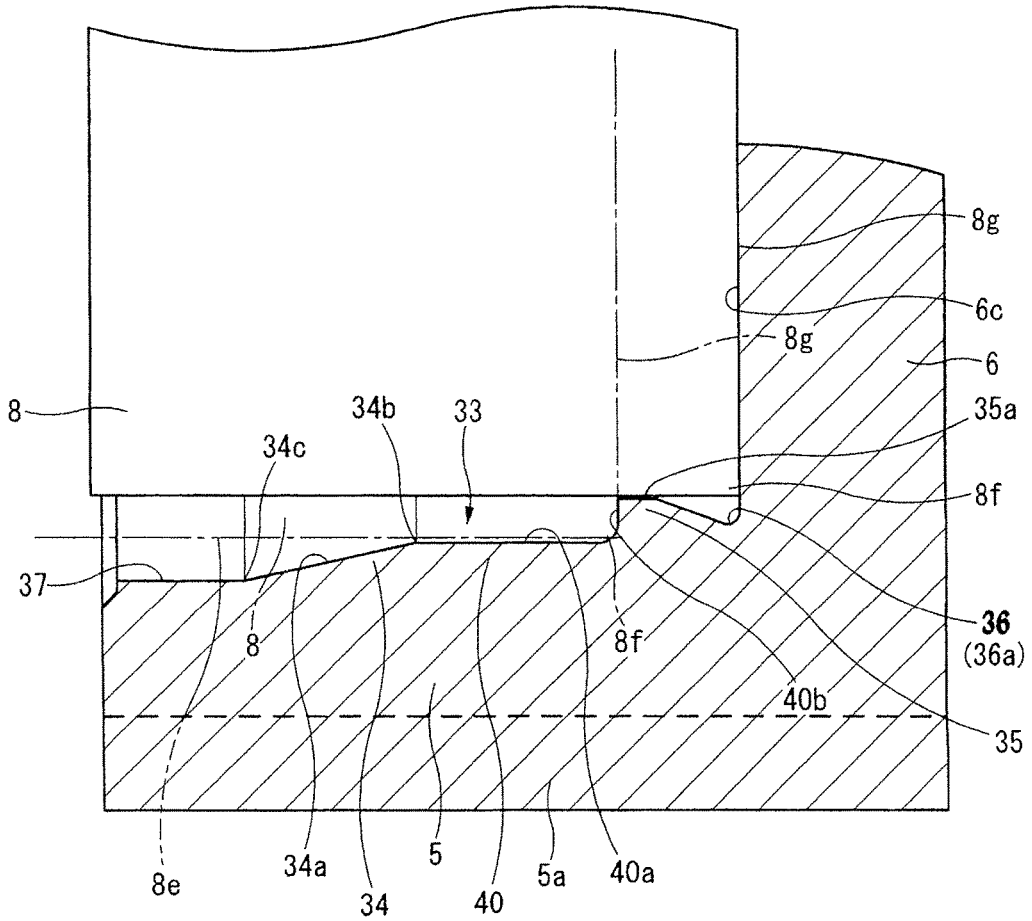
FIG. 8 is an enlarged sectional view showing a state where a housing is inserted into a drive pulley, and a state where the housing is being inserted into the drive pulley in the second embodiment.

Accordingly, in this embodiment, as described above, at the assembly operation of the constituting members, when the housing 8 (the housing unit) is inserted from the one end opening side (the tapered surface) of the drive pulley 1, the front end outer circumference edge 8*f* of the housing 8 is moved to be slidably abutted on the guide surfaces 34*a* of the guide portion 34. When the front end outer circumference edge 8*f* reaches the approach portions 40, portions of the front end surface 8*g* of the housing 8 is abutted on the stepped surfaces 40*b*, and once mounted on the stepped surfaces 40*b*, as shown by one dot chain line in FIG. 8. With this, when the housing 8 is inclined, the posture of the housing 8 is corrected. When the housing 8 is further inserted in this corrected posture, the entire of the outer circumference surface 8*e* of the front end portion is abutted on the mounting surfaces 35*a* of the mounting protrusion portions 35, as shown by a solid line in FIG. 8. Finally, it is possible to perform the stable positioning (centering) operation with the high accuracy.

In this way, in this embodiment, the approach portions 40 are provided. With this, even when the entire of the housing 8 is inclined in the guide portions 34 as described above when the housing 5 is inserted into the cylindrical wall 5, the inclined posture of the housing 8 is forcibly corrected when the housing 8 reaches the approach is portions 40. Accordingly, it is possible to perform the positioning operation with the high accuracy in the region of the mounting protrusion portions 35. Consequently, it is possible to constantly perform the sure, stable positioning operation without using specific devices, and to improve the working efficiency of the assembly operation.

Third Embodiment

Figure 9:
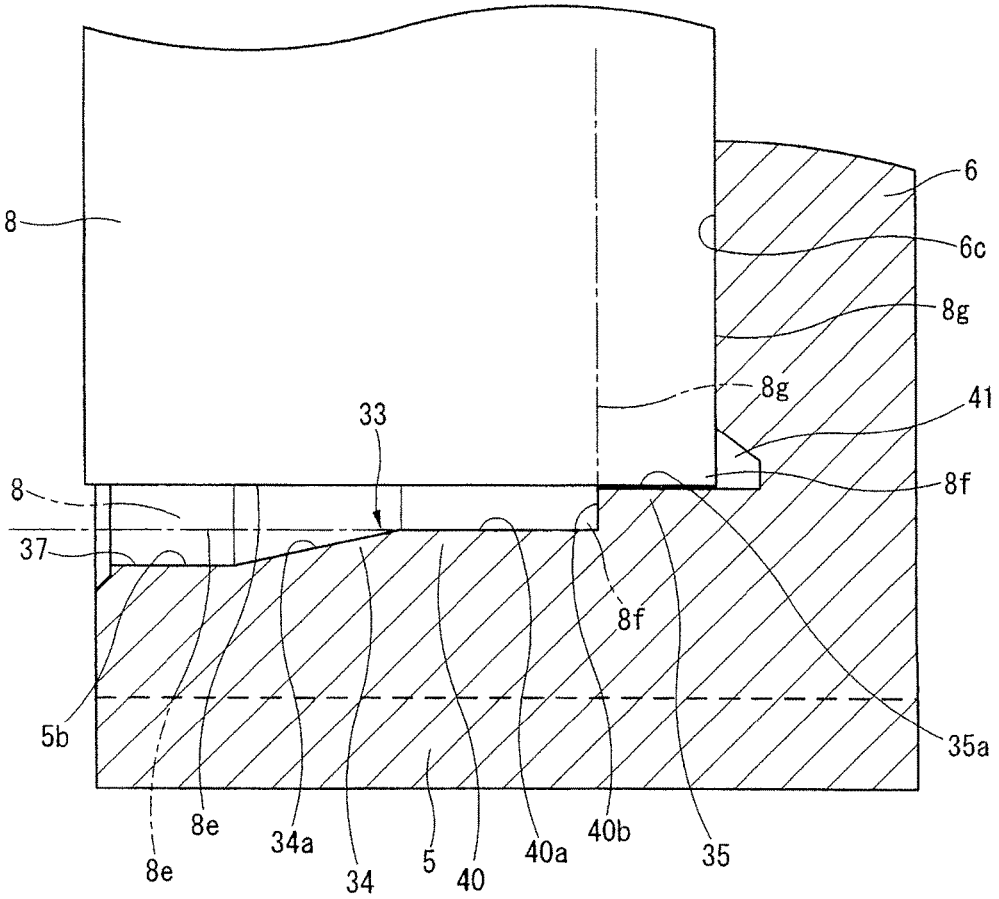
FIG. 9 is an enlarged sectional view showing a main part of a drive pulley in a third embodiment according to the present invention.

FIG. 9 shows a third embodiment. The third embodiment has a basic configuration identical to that of the second embodiment in which the approach portions 40 are formed. However, each of the mounting protrusion portions 35 is formed to extend to the bottom surface 6*c* of the bottom wall 6. An annular recessed portion 41 is formed on the bottom surface 6*c* of the bottom wall 6 at a position to confront the mounting protrusion portions 35 in the axial direction.

That is, the annular recessed portion 41 is formed on the bottom surface 6*c* at a portion to which the mounting surface 35*a* of the mounting protrusion portion 35 extends in the axial direction to the bottom surface 6*c* of the bottom wall 6, so as to be recessed in the axially outward direction. The annular recessed portion 41 has a substantially trapezoid cross section. Accordingly, it is possible to sufficiently decrease the side clearance between the front end surface 8*g* of the housing 8 and the bottom surface 6*c* of the bottom wall 6 by the annular recessed portion 41. Moreover, it is possible to improve the readiness of the positioning operation and the positioning accuracy at the insertion of the housing 8.

That is, the annular recessed portion 41 is not formed on the inner circumference surface 5*b* of the cylindrical wall 5, but formed on the bottom surface 6*c* of the bottom wall 6. With this, it is possible to increase the area of the mounting surface 35*a* of the mounting protrusion portion 35 relative to the other embodiments, and thereby to increase the contact area with the outer circumference surface 8*e* of the front end portion of the housing 8. Moreover, it is possible to ease the positioning operation at the insertion of the housing 8, and to improve the positioning accuracy.

Besides, this annular recessed portion 41 is also formed by the mechanical processing by the lathe after the sintering of the drive pulley 1.

The present invention is not limited to the configurations of the embodiments. For example, the drive rotation member may be a drive sprocket including an outer circumference around which the timing chain is wound, in addition to the drive pulley 1.

Moreover, the axial length of the guide portion 34 may be further extended toward the tapered surface 37. The inclination angle of the guide portion 34 may be arbitrarily varied.

Furthermore, the axial length of the mounting protrusion portion 35 may be arbitrarily elongated. Moreover, the inside diameter of the mounting surface 35*a* may be arbitrarily set in accordance with the outside diameter of the housing 8.

The invention claimed is:

1. A valve timing control apparatus for an internal combustion engine, the valve timing control apparatus comprising:

a drive rotation member including a cylindrical wall to which a rotational force from a crank shaft is transmitted through teeth portions of an outer circumference, and which includes an opening opened on an one axial end side, and a bottom wall which is integrally provided on the other axial end side of the cylindrical wall, and which includes a through hole formed at a center;

a housing which has a cylindrical shape, which is received within the drive rotation member, which includes one end opening closed by the bottom wall, and a plurality of shoes protruding from an inner circumference surface, and which includes a plurality of hydraulic chambers formed by the plurality of shoes;

a vane rotor which is received within the housing to be rotated relative to the housing, which includes a rotor portion fixed at one end portion of a cam shaft, and vanes provided from an outer circumference surface of the rotor portion in radial directions, and which separates the hydraulic chambers into a retard angle hydraulic chamber and an advance angle hydraulic chamber, with the shoes; and a front plate which closes the other end opening of the housing, and which is connected to the housing and the drive rotation member from an axial direction, the drive rotation member including a positioning mechanism including a guide portion which is formed on an inner circumference surface of the cylindrical wall, and which has an inclined shape whose an inside diameter is decreased from the one axial end side to the other axial end side, a mounting protrusion portion which is formed on the other end side of the guide portion, and on which an outer circumference surface of the housing is mounted to be positioned.

2. The valve timing control apparatus for the internal combustion engine as claimed in claim 1, wherein the plurality of the vanes include a specific vane provided with a lock pin arranged to be projectable and retractable in the axial direction of the cam shaft; the bottom wall of the drive rotation member includes a lock hole which the lock pin is engaged in and disengaged from; the specific vane is arranged to be abutted on a pair of shoes of the plurality of the shoes of the housing in the rotation direction, and thereby to restrict a maximum advance angle position and a maximum retard angle position of the vane rotor; the plurality of the operation chambers include a specific operation chamber formed by a side surface of side surfaces of the pair of the shoes forming the retard angle operation chamber and the advance angle operation chamber, the side surface on which the specific vane is not abutted; and the mounting protrusion portion is mounted on the outer circumference surface of the specific operation chamber of the housing.

3. The valve timing control apparatus for the internal combustion engine as claimed in claim 1, wherein the positioning mechanism includes an approach portion which has a stepped shape, and which is positioned between the guide portion and the mounting protrusion portion.

4. The valve timing control apparatus for the internal combustion engine as claimed in claim 3, wherein the cylindrical wall and the bottom wall of the drive rotation member are integrally formed from a sintered metal.

5. The valve timing control apparatus for the internal combustion engine as claimed in claim 4, wherein an annular recessed portion is formed between the bottom wall and the mounting protrusion portion; and the annular recessed portion is recessed in a radially outward direction relative to the mounting protrusion portion.

6. The valve timing control apparatus for the internal combustion engine as claimed in claim 4, wherein an annular recessed portion is formed between the bottom wall and the mounting protrusion portion; and the annular recessed portion is recessed in an axially outward direction relative to a bottom surface of the bottom wall.

7. The valve timing control apparatus for the internal combustion engine as claimed in claim 4, wherein a tapered surface is formed on the inner circumference surface of the cylindrical wall of the drive rotation member on the other axial end side of the cylindrical wall of the drive rotation member which is opened; the tapered surface is continuous with the guide portion; and the tapered surface has a diameter gradually decreased in a direction of the guide portion.

8. The valve timing control apparatus for the internal combustion engine as claimed in claim 1, wherein the guide portion and the mounting protrusion portion are continuous with each other in the axial direction.

9. The valve timing control apparatus for the internal combustion engine as claimed in claim 1, wherein a groove portion is formed by cutting a circumferential portion of the mounting protrusion portion of the cylindrical wall, in the axial direction of the cylindrical wall.

10. The valve timing control apparatus for the internal combustion engine as claimed in claim 9, wherein an oil drain hole is formed in the bottom wall at a position corresponding to the groove portion; and the oil drain hole penetrates through the bottom wall.

11. The valve timing control apparatus for the internal combustion engine as claimed in claim 1, wherein the guide portion includes a portion having an upward inclination surface inclined upward from the one axial end side of the cylindrical wall which is opened, to the other axial end side of the bottom wall side, and an annular surface extending from an end edge of the inclination surface to the other axial end side.

12. The valve timing control apparatus for the internal combustion engine as claimed in claim 11, wherein the cylindrical wall includes a tapered surface formed on the inner circumference surface on the one axial end side; and the tapered surface has an inclination angle smaller than an inclination angle of the guide portion.

13. The valve timing control apparatus for the internal combustion engine as claimed in claim 12, wherein the tapered surface is a tapered surface for extracting a die when the drive rotation member is sintered.

14. A valve timing control apparatus for an internal combustion engine, the valve timing control apparatus comprising:

a drive rotation member which has a cylindrical bottomed shape, and to which a rotation force from a crank shaft is transmitted;

a housing which has a cylindrical shape, which is received within the drive rotation member, which includes one end opening fixed to a bottom wall of the drive rotation member, and a plurality of shoes formed on an inner circumference surface to protrude from the inner circumference surface;

a vane rotor which is received within the housing to be rotated relative to the housing, which is fixed to one end portion of a cam shaft, and which separates an inside of the housing into a retard angle operation chamber and an advance angle operation chamber, in cooperation with the shoes; and a front plate closing the other end opening of the housing, the drive rotation member including a positioning mechanism including a mounting protrusion portion which is formed on an inner circumference surface of the cylindrical wall, and on which an outer circumference surface of one axial end portion of the housing is mounted, and a guide portion which is formed on the inner circumference surface of the cylindrical wall, and which is arranged to guide the housing in a mounting direction when the housing is mounted on the mounting protrusion portion in the axial direction.

15. The valve timing control apparatus for the internal combustion engine as claimed in claim 14, wherein the guide portion includes an approach portion which is formed on the other axial end side of the mounting protrusion portion of the cylindrical wall, and which is a stepped shape having a radius larger than a radius of the mounting protrusion portion.

* * * * *